US006047413A

United States Patent [19]

Welchel et al.

[11] Patent Number: 6,047,413

[45] **Date of Patent: *Apr. 11, 2000**

[54] CONFORMABLE BACKPACK FOR ENCAPSULATED CHEMICAL PROTECTION SUIT

[75] Inventors: Debra Nell Welchel, Woodstock; Vivian Gray, Marietta; Alan Edward Wright, Woodstock, all of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/052,779

[22] Filed: Mar. 31, 1998

[51] Int. Cl.[7] ..... A62B 17/00; A41D 13/00

[52] U.S. Cl. ..... 2/457; 2/456; 2/2.17; 2/69.5; 2/901; 224/645

[58] Field of Search ..... 2/457, 456, 458, 2/2.17, 78.3, 79, 81, 167, 69.5, 94, 93, 901, 69; 224/627, 645, 651; 383/2

[56] References Cited

U.S. PATENT DOCUMENTS

| | | | |
|---|---|---|---|
| 1,367,182 | 2/1921 | Gardi . | |
| 1,426,024 | 8/1922 | Thureson . | |
| 2,150,251 | 3/1939 | Shanhouse . | |
| 2,248,455 | 7/1941 | Freund . | |
| 2,448,416 | 8/1948 | Carter . | |
| 2,507,322 | 5/1950 | Smith . | |
| 2,620,479 | 12/1952 | Buck | 2/94 |
| 4,100,324 | 7/1978 | Anderson et al. . | |
| 4,257,127 | 3/1981 | Kaupin et al. . | |
| 4,286,439 | 9/1981 | Pasternack . | |
| 4,403,608 | 9/1983 | Warncke . | |
| 4,434,920 | 3/1984 | Moore | 224/160 |
| 4,581,752 | 4/1986 | De Luca . | |
| 4,670,913 | 6/1987 | Morrell et al. . | |
| 4,689,831 | 9/1987 | Greenberger et al. | 2/93 |
| 4,720,415 | 1/1988 | Vander Wielen et al. . | |
| 4,864,654 | 9/1989 | Schriver et al. . | |
| 4,884,731 | 12/1989 | Sibley | 224/215 |
| 4,949,401 | 8/1990 | Kinsey, Jr. . | |
| 4,981,747 | 1/1991 | Morman . | |
| 4,992,335 | 2/1991 | Guerra et al. . | |
| 5,005,216 | 4/1991 | Blackburn et al. . | |
| 5,019,453 | 5/1991 | Guerra . | |
| 5,034,998 | 7/1991 | Kolsky . | |
| 5,035,941 | 7/1991 | Blackburn . | |
| 5,116,662 | 5/1992 | Morman . | |
| 5,123,117 | 6/1992 | Prendergast . | |
| 5,221,572 | 6/1993 | Meunier . | |
| 5,279,287 | 1/1994 | Wiseman, Sr. . | |
| 5,336,545 | 8/1994 | Morman . | |

(List continued on next page.)

FOREIGN PATENT DOCUMENTS

| | | |
|---|---|---|
| 432492 | 6/1991 | European Pat. Off. . |
| 0672357 A2 | 2/1995 | European Pat. Off. . |
| 1577493 | 8/1969 | France . |
| 1187487 | 2/1965 | Germany . |
| 3603639 | 8/1987 | Germany . |
| 2199233A | 7/1988 | United Kingdom . |
| 94/12065 | 6/1994 | WIPO . |
| 95/08276 | 3/1995 | WIPO . |

OTHER PUBLICATIONS

U.S. application No. 08/940,904, filed Sep. 30, 1997.
U.S. application No. 08/988,123, filed Dec. 10, 1997.
Abstract for DE 3603639, Assignee: Vorndamme H Ohg.

(List continued on next page.)

*Primary Examiner*—John J. Calvert
*Assistant Examiner*—Tejash D Patel
*Attorney, Agent, or Firm*—Nancy M. Klembus

[57] ABSTRACT

The present invention is directed toward protective garments having a conformable backpack portion located on a back area of the garment, the conformable backpack portion being adapted to conform to equipment worn on a back of a wearer of the protective garment.

24 Claims, 8 Drawing Sheets

U.S. PATENT DOCUMENTS

| | | | |
|---|---|---|---|
| 5,407,112 | 4/1995 | Christodoulou et al. | 224/153 |
| 5,421,326 | 6/1995 | Rankin et al. . | |
| 5,429,707 | 7/1995 | Smith . | |
| 5,435,045 | 7/1995 | Anscher | 24/482 |
| 5,453,314 | 9/1995 | Collier et al. . | |
| 5,487,189 | 1/1996 | Bell . | |
| 5,491,022 | 2/1996 | Smith . | |
| 5,492,753 | 2/1996 | Levy et al. . | |
| 5,494,720 | 2/1996 | Smith et al. . | |
| 5,509,142 | 4/1996 | Connell et al. . | |
| 5,520,980 | 5/1996 | Morgan et al. . | |
| 5,529,830 | 6/1996 | Dutta et al. . | |
| 5,560,974 | 10/1996 | Langley . | |
| 5,588,153 | 12/1996 | Ignon et al. | 2/457 |
| 5,624,729 | 4/1997 | Cohen et al. . | |
| 5,634,579 | 6/1997 | Baclawski | 224/637 |
| 5,689,968 | 11/1997 | Frustaci et al. . | |
| 5,699,560 | 12/1997 | Greenberg | 2/94 |
| 5,743,447 | 4/1998 | McDermott | 224/153 |

OTHER PUBLICATIONS

GB 1240939 —English equivalent for FR 1577493.
Abstract for France 2309115, Nov. 19, 1976.
Abstract for France 2497443, Sep. 07, 1982.
Abstract for France 2586174, Feb. 20, 1987.
Abstract for Japan 10168612 to Onyone KK, Jun. 23, 1998.

CONFORMABLE BACKPACK FOR ENCAPSULATED CHEMICAL PROTECTION SUIT

FIELD OF THE INVENTION

The field of the present invention is that of protective apparel.

BACKGROUND OF THE INVENTION

There are many types of limited use or disposable protective garments and apparel designed to provide barrier properties. One type of protective garment is protective coveralls. Coveralls can be used to effectively seal off a wearer from a harmful environment in ways that open or cloak style garments such as, for example, drapes, gowns, shirts, pants and the like are unable to do. Accordingly, coveralls have many applications where isolation of a wearer from a work environment is desirable. For example, it may be desirable to isolate a worker from a hazardous environment. As another example, it may be desirable to isolate an environment (e.g., a clean room) from a worker.

For a variety of reasons, it is desirable for protective garments to be manufactured from materials which prevent or significantly retard the passage of hazardous liquids and/or pathogens therethrough. It is also desirable for the protective apparel to isolate persons from dusts, powders, and other particulates which may be present in a work place or accident site. Generally speaking, protective apparel rely on the barrier properties of the fabrics used in their construction. Some of these fabrics may even have received treatments to enhance barrier properties.

Barrier performance of protective apparel also depends on the design and construction of the garment. Apparel containing many seams may be unsatisfactory, especially if the seams are located in positions where they may be subjected to stress and/or direct contact with hazardous substances. Seams located at the front of apparel are particularly susceptible to stress and/or direct contact with hazardous substances. For example, seams that join sleeves or legs to the body portion of protective coveralls are often subjected to stress. Moreover, sleeve seams in the front of coveralls and seams about the chest are at locations of frequent accidental splashing, spraying and/or other exposures.

After use, it can be costly to decontaminate protective apparel that has been exposed to hazardous substances. Thus, there exists a need in the art for protective apparel which is more easily decontaminated. Protective apparel (garments) must be worn correctly to reduce the chance of exposure. Workers are more likely to wear protective garments (e.g., protective coveralls) properly if the garments are comfortable. One way to increase comfort is to have the garment fit well. A protective garment that fits well also is advantageous in that, when the wearer is working in a confined space, generally speaking, the better fitting the protective garment, the less likely it is that the protective garment will be inadvertently torn, punctured or get "hung up on" the worker's surroundings. This is so because a good fitting protective garment will tend to conform more closely to the wearer's body. Accordingly, if the wearer stays clear of surrounding projections etc., as is the natural tendency, the likelihood of the protective garment contacting projections etc. will be decreased.

One of the problems associated with achieving a satisfactory fit in those protective garments which totally enclose the wearer is the fact that the wearer of the garment, because s/he is totally enclosed by the garment, needs to wear equipment, such as life support air tanks, on his/her back. Accordingly, in such instances, the protective garment must also enclose this equipment. Past protective garment designs have attempted to address this problem by incorporating a backpack onto the back area of the garment. This backpack may be envisioned as joining a bag-shaped appendage about an opening located in the back area of the garment with the opening and the bag being shaped to receive equipment such as, for example, life support equipment.

While these prior backpack containing protective garments have been marketed and sold, they are not without problems. One problem is that their backpacks do not possess any viable mechanism by which they tend to conform to the equipment. That is, there is no mechanism urging a tight, yet comfortable, fit. Accordingly, the bag portion of these backpacks tends to hang down in a crumpled or multi-folded manner. The downward hanging of these packs creates problems in that the bag portion of the backpack has a greater tendency to hang-up on or get snagged by objects in the work area. Naturally, this situation is not desirable in that it may well lead to the garment being ripped or torn and thus compromised. Another problem associated with this type of backpack on protective garments is that the many folds in the bag portion of the garment tend to retain contaminates from the work area. This makes decontamination of the garment when the wearer wishes to exit it more difficult, time consuming and thus, more frustrating.

Thus, a need exists for an inexpensive protective garment with attached backpack which provides a better fit, is more comfortable to wear, reduces the tendency of the backpack to snag and/or which reduces the degree of retention of contaminates retained within the folds of the backpack.

OBJECTS OF THE INVENTION

Accordingly, it is a general object of the present invention to provide protective apparel which has the ability to enclose equipment such as life support equipment worn on the back of the wearer of the apparel.

Another object of the present invention is to provide protective apparel which has the ability to enclose life support equipment worn on the back of the wearer of the apparel which is comfortable.

Yet another object of the present invention is to provide protective apparel where the portion of the apparel which is designed to enclose life support equipment worn on the back of the wearer has the ability to conform to worn by the wearer equipment.

Still further objects and the broad scope of applicability of the present invention will become apparent to those of skill in the art from the details given hereinafter. However, it should be understood that the detailed description of the presently preferred embodiment of the invention disclosed herein is given only by way of illustration. Various changes and modifications which are well within the spirit and scope of the present invention will become apparent to those of skill in the art in view of the following description.

DEFINITIONS

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Pat. No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "sheet" refers to a material that may be a film, nonwoven web, woven fabric or knit fabric.

As used herein, the term "microfibers" means small diameter fibers having an average diameter not greater than about 100 microns, for example, having a diameter of from about 0.5 microns to about 50 microns, or more particularly, microfibers may have an average diameter of from about 4 microns to about 40 microns. Average fiber diameter may be calculated by taking at least ten random measurements of fiber diameters and averaging those measurements.

As used herein, the term "disposable" is not limited to single use articles but also refers to articles that can be discarded if they become soiled or otherwise unusable after only a few uses.

As used herein, particle holdout efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (Jan. 15, 1991) performed by InterBasic Resources, Inc. of Grass Lake, Mich. This IBR Test Method determines the air filter retention of particles from approximately 0.1 $\mu$m to 100 $\mu$m. The test is a single pass challenge test wherein a concentrate suspension of contaminate is injected into a feed stream toward the test filter. Particle size distribution and number is determined both upstream and downstream of the test filter by an autornatic particle counter. The contaminate consists of dry particles, such as a fine or coarse grade of AC Test Dust supplied by A.C. Spark Plug Division of the General Motors Corporation, which are suspended in pure air. Generally speaking, a high particle holdout efficiency is desirable for barrier materials. Desirably, a particle resistant material should have a particle holdout efficiency of at least about 40 percent for particles having a diameter greater than about 0.1 micron.

As used herein, the term "liquid chemical resistance" refers to a fabric having a useful level of resistance to penetration by a liquid through either penetration or permeation. As used herein, penetration is the flow of bulk liquid through the fabric. As used herein, permeation is the process by which a chemical moves through the fabric on a molecular level. Penetration resistance of materials may be measured using ASTM F903, a standard test method that visually determines material barrier performance against liquid chemicals under conditions of continuous contact. In such a test, a fabric swatch is placed into a test cell. The chemical barrier side of the fabric is placed in contact with a test chemical for one hour with part of the contact period performed under pressure. The condition of the fabric on the other (interior) side is periodically monitored to determine if the test chemical is seen penetrating the fabric. Results are expressed as "pass" or "fail". A material passes the test when there is no visual evidence of liquid penetration after the one hour test period. Any visual detection of penetrating liquid during the test period constitutes failing performance. Permeation resistance of materials may be measured by ASTM F739which provides a standard test method designed to measure the resistance of materials to permeation by liquids and gaseous chemicals under the condition of continuous contact. In the test, a fabric swatch divides a test cell into two different chambers. A first chamber is filled with the chemical being tested. A collection gas or liquid is used in a second chamber in combination with an analytical instrument to detect chemical molecules permeating into the second chamber through the fabric. The results of the test are expressed by a permeation rate which is the maximum rate at which the permeating chemical passed through the fabric as measured by the analyzer. The permeation rate is reported as micrograms per square centimeter of fabric per minute. Additionally, a Normalized Breakthrough Time ("NBT") may be reported, the NBT being the elapsed time (reported in minutes) measured from the start of the test to the time the permeating chemical reaches a permeation rate of 0.1 Pg/cm$^2$min.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein and in the claims, the term "elastic" means any material which, upon application of a biasing force, is stretchable, that is, elongatable, to a stretched biased length which is at least twenty-five percent (25%) greater than its relaxed, unbiased length, and which will recover at least a portion of its elongation upon release of the biasing force. A composite elastic material may include two or more layers. As used herein, the term "nonelastic" refers to any material which does not fall within the definition of elastic.

The term "recover" refers to a contraction of a stretched or elongated material upon termination of a biasing force following stretching of the material from some initial measurement by application of the biasing force. For example, if a material having a relaxed, unbiased length of one (1) centimeter is elongated fifty percent (50%) by stretching to a length of one-and-one-half centimeters, the material is elongated fifty percent (50%) and has a stretched length that is one hundred and fifty percent (150%) of its relaxed length. If this stretched material contracts, that is, recovers to a length of one-and-one-tenth (1.1) centimeters after release of the biasing and stretching force, the material has recovered eighty percent (80%), or 0.4 centimeters of its one-half (0.5) centimeter elongation. Percent recovery may be expressed as [(maximum stretch length–final sample length)/(maximum stretch length–initial sample length)]× 100.

The term "gather" as used herein means to draw into folds, tucks, puckers, loops or the like. The term "gatherable web" refers to a web which can be gathered into folds, tucks, puckers or the like by contraction of the web.

As used herein the term "generally vertical" refers to a configuration which an ordinary observer would consider to be vertical. With respect to the present invention, the wearer of the protective suit's backbone would be the reference point for any determination of verticality.

As used herein, any given range is intended to include any and all lesser included ranges. For example, a range of from 45–90 would also include 50–90; 45–80; 46–89 and the like.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

In response to the foregoing challenges which have been experienced by those of skill in the protective apparel art, the present invention is directed toward a protective garment having a conformable backpack portion located on a back area of the garment, the conformable backpack portion being adapted to conform to equipment worn on a back of a wearer of the protective garment. The conformable backpack portion may include an outer protective layer which is gathered. A plurality of elastic members may be connected to the outer protective layer so that the outer protective layer is drawn toward and conforms to the equipment worn by the wearer. The elastic members may be connected to an interior surface of the outer protective layer of the backpack portion by a variety of ways. For example, at least one loop may be mounted to the interior surface of the outer protective layer, the elastic member being slidably received within the loop. A plurality of loops may be utilized, the elastic member being slidably received within at least one of the loops. The elastic member may be attached to or about at least one of the loops.

In another embodiment, a drawstring which is slidably connected to the outer protective layer gathers the outer protective layer. In a particular embodiment, at least one loop is mounted to the interior surface of the outer protective layer, the drawstring being slidably received within the loop. In another embodiment, a plurality of loops are utilized. The drawstring may also be attached to or about at least one of the loops.

In one embodiment, a channel is connected to the interior surface of the outer protective layer of the backpack portion. The channel may be formed in or attached to the interior surface of the outer protective layer, the drawstring or elastic member being slidably received within at least a portion of the channel. The drawstring or elastic member may be secured at one or more locations to the channel or outer protective layer.

In yet another embodiment, the outer protective layer is elasticized so that it conforms to the equipment worn by the wearer. In one embodiment, an elastic web may be connected to the interior surface of the outer protective layer while the elastic web is in a stretched condition so that, when the elastic web is relaxed, the outer protective layer is gathered. The elastic web may be connected to the interior surface by adhesive bonding or other similar attachment method.

In still another embodiment, the backpack portion further includes a bottom portion, the bottom portion having a contaminate runoff angle of from greater than 0 to 90 degrees. In selected embodiments, the contaminate runoff angle may be from greater than 0 degrees to less than 90 degrees. In other selected embodiments, the contaminate runoff angle may be from about 30 degrees to about 60 degrees. In yet other selected embodiments, the contaminate runoff angle may be about 45 degrees. The bottom portion may include an upwardly concave arc.

Other objects, advantages and applications of the present invention will be made clear by the following detailed description of a preferred embodiment of the invention.

DETAILED DESCRIPTION OF THE INVENTION

Figure 1:
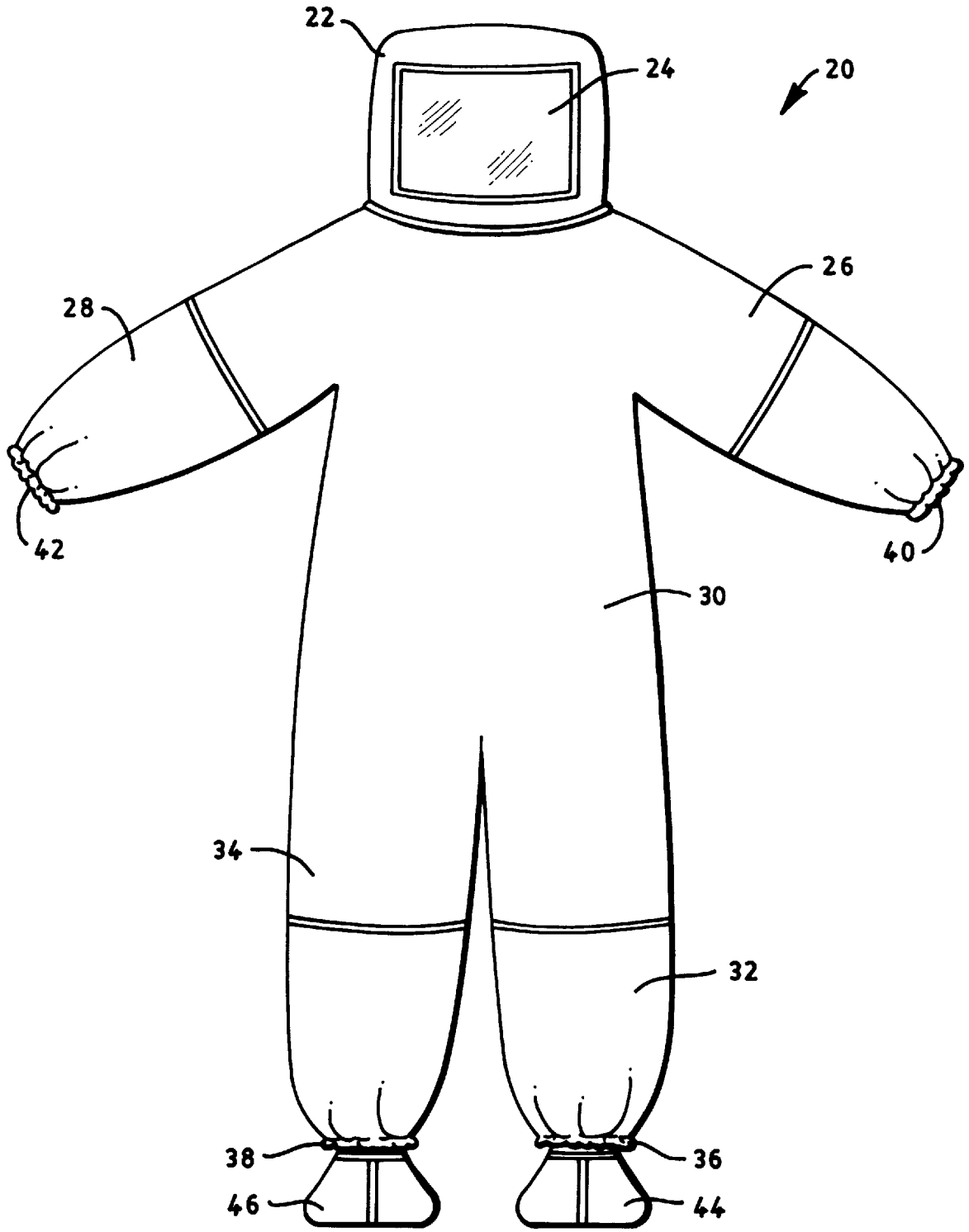
FIG. 1 is a front view of a protective garment.

Turning now to the drawings where like reference numerals represent like or equivalent structure or process steps, FIG. 1 illustrates a front view of a protective garment 20. The protective garment 20 includes a head receiving portion 22 with a view plate 24. The protective garment also includes left and right arm receiving portions 26, 28, a body receiving portion 30 and left and right leg receiving portions 32, 34. The protective garment 20 may include left and right ankle elastic portions or cuffs 36, 38 and left and right wrist elastic portions or cuffs 40, 42 which form a tight fit around the wearer's wrists and ankles in order to maintain the interior of the protective garment in a non-contaminated state. In some embodiments, the protective garment 20 may also include left and right foot or shoe covering portions 44, 46.

Generally speaking, the seams and points of attachment in the garment 20 may be formed by any suitable means such as, for example, by sewing or stitching, taping, ultrasonic bonding, solvent welding, adhesives, thermal bonding and the like. The closure means may be any suitable closure mechanism such as, for example, zippers, button fasteners, dip fasteners, snap fasteners, hook and loop fasteners, resealable tapes, ziplock fasteners, magnetic fasteners and the like. Thus, various portions of the garment may be joined or attached by sewing or stitching, ultrasonic bonding, solvent welding, adhesives, thermal bonding and similar techniques.

The material used in the construction of the protective garment may be one or more bonded carded webs, webs of spunbonded filaments, webs of meltblown fibers. The material may also be one or more knit or woven materials. It is contemplated that the material may be one or more films.

Such material (e.g., nonwoven webs, woven materials, knit materials or films) may be formed from polymers such as, for example, polyamides, polyolefins, polyesters, polyvinyl alcohols, polyurethanes, polyvinyl chlorides, polyfluorocarbons, polystyrenes, caprolactams, poly (ethylene vinyl acetates), ethylene n-butyl acrylates, and cellulosic and acrylic resins. If the nonwoven web is formed from a polyolefin, the polyolefin may be polyethylene, polypropylene, polybutene, ethylene copolymers, propylene copolymers and butene copolymers.

Although a wide variety of materials may be utilized in the present invention, a material which is particularly well suited for the protective garment described herein is a polypropylene spunbonded web having a basis weight of 1.75 ounces per square yard (osy) and one percent (1%) by weight of titanium dioxide, the polypropylene web being laminated to a single layer of SARANEX® 23P film which is manufactured by the Dow Chemical Corporation. Such a material is a lightweight durable fabric which provides effective resistance to a broad range of liquid and dry particulate chemicals. Such a material is utilized by the assignee of record, the Kimberly-Clark Corporation of Neenah, Wis., in disposable clothing manufactured under the HAZARD-GARD® mark.

Figure 2:
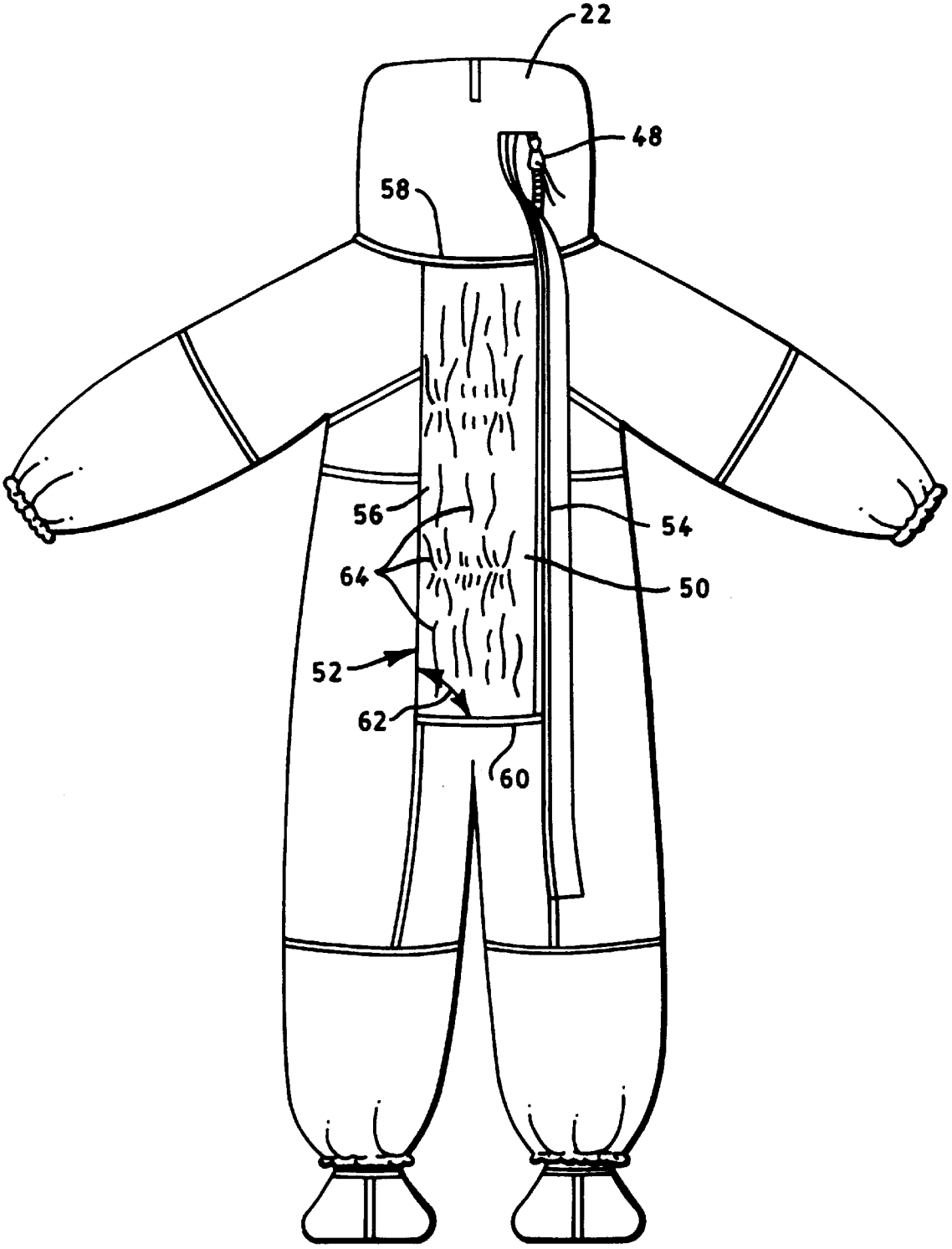
FIG. 2 is a rear view of a protective garment according to the present invention.

FIG. 2 is a rear view of the protective garment 20 of FIG. 1, which illustrates that the protective garment 20 may be entered from the rear through the use of a zipper 48. FIG. 2 also illustrates that the protective garment 20 has been provided with a backpack 50 which has the ability to variably adapt to conform to a variety of types of equipment (not shown) carried on the back of the wearer. The backpack 50 has outer edges 52, 54 and an outer protective layer 56.

In the embodiment depicted in FIG. 2, the backpack 50 begins or has a top or upward termination edge or line 58 where the helmet or head receiving portion 22 ends. Desirably, this upward edge or line 58 forms an upwardly facing concavity. This configuration allows ease of transition from the base of the generally circular helmet or head receiving portion 22 and makes it easier for the wearer to turn his/her head back and forth. Naturally, other embodiments where the upward termination edge 58 of the backpack 50 is straight or otherwise variously formed are contemplated.

The backpack 50 terminates at a bottom edge 60 with a seal or seam that is generally perpendicular (90 degrees) to the generally vertical outer edges 52, 54 of the backpack 50. The angle formed by one of the outer edges 52, 54 and the bottom edge 60 is referred to herein as the contaminate runoff angle and is denoted in FIGS. 2 and 9 at 62. The contaminate runoff angle 62 depicted in FIG. 2 is approximately 90°. Typical backpack 50 lengths, as measured at the midpoint of the backpack between the two outer edges 52, 54 from the upward termination edge 58 to the bottom edge 60, would range from about 62 to about 88 cm (about 25 to about 35 inches). One desirable length is about 79 cm (about 31.5 inches).

FIG. 2 shows gathers 64 formed in the outer protective layer 56 of the backpack 50. The gathers 64 may be formed by a variety of means and in a variety of patterns. For example, the gathers 64 may be formed along the entire length and width of the backpack. Alternately, selected portions of the backpack may be gathered, such as, for example, an upper portion and/or a lower portion of the backpack.

Figure 3:
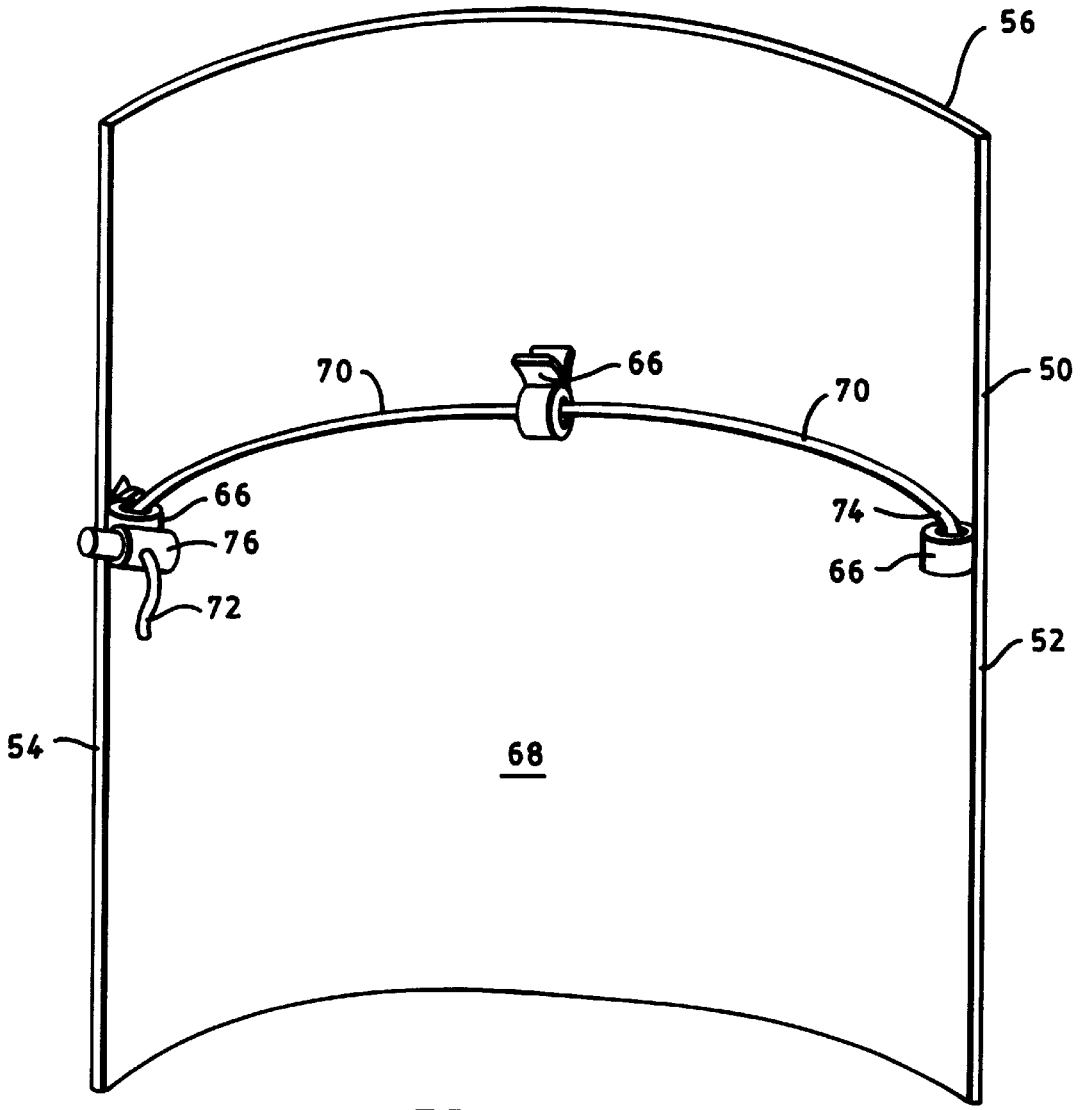
FIG. 3 is an interior view of one embodiment of the backpack portion of the protective garment according to the present invention.

One way of forming gathers 64 in the backpack 50 is depicted in FIG. 3, which shows an interior view of the ungathered backpack portion 50 of the garment. As shown therein, a plurality of loops 66 are attached to the interior surface 68 of the outer protective layer 56. The loops 66 are preferably formed of a strap of material and attached to the interior surface 68 by any of a variety of attachment means, such as sewing or stitching, taping, ultrasonic bonding, solvent welding, adhesives, thermal bonding and the like. The loops 66 may be formed in any of a number of ways, including folding the strap in half so that the edges are aligned with each other, or forming the strap into a circle so that the ends of the strap meet or overlap.

As shown in FIG. 3, a drawstring 70 having ends 72 and 74 is slidably received within at least one of the loops 66. In a particular embodiment, the end 74 of the drawstring 70 is secured to the protective garment 20. As depicted in FIG. 3, end 74 is secured to the loop 66 which is positioned proximate to the edge 52 by sewing, taping, bonding or other similar attachment method. Alternately, end 74 may be attached directly to the interior surface 68 of the outer protective layer 56.

After the wearer has entered the protective garment 20, the end 72 of the drawstring 70 may be pulled, thereby gathering the outer protective layer 56 and conforming the backpack 50 to the equipment worn by the wearer.

Once the drawstring 70 has been pulled to a length sufficiently short so as to conform the backpack 50 to the equipment, the drawstring 70 may be variously secured in this shortened position. For example, a barrel lock 76, which is depicted in FIG. 3 may be used to secure the drawstring 70 in its shortened position. The barrel lock 76 may be formed from a cylindrical inner portion which is slidably received within at least a portion of a cylindrical outer portion. An aperture is formed in both cylindrical portions, the cylindrical portions being biased with respect to one another so that an aperture in the inner cylindrical portion is not fully aligned with the aperture in the outer cylindrical portion. Upon sufficient application of force to the barrel lock 76, the apertures may be aligned so that the drawstring 70 may be passed through both apertures. Upon release of the force, the cylindrical portions return to their biased positions wherein the sides of the apertures of the cylindrical portions bear on the drawstring 70, securing the barrel lock 76 onto the drawstring 70 in a particular location. The barrel lock 76 is sized so as to be sufficiently large with respect to the loop 66 so that the barrel lock 76 cannot slide through the loop 66, thereby preventing the drawstring 70 from withdrawing through the loops. Alternately, the drawstring 70 may be retained within the loops 66 by simply forming a knot in the drawstring 70, the knot being appropriately sized so as to prevent the drawstring 70 from sliding through the loop 66, or tying the drawstring 70 to a loop 66.

In alternate embodiments, both ends 72, 74 of the drawstring 70 may be pulled to shorten the drawstring and gather the outer protective layer 56. In such an embodiment, it may be desirable to secure the drawstring 70 to a loop 66 which is positioned centrally with respect to the edges 52, 54 of the backpack 50.

Figure 4:
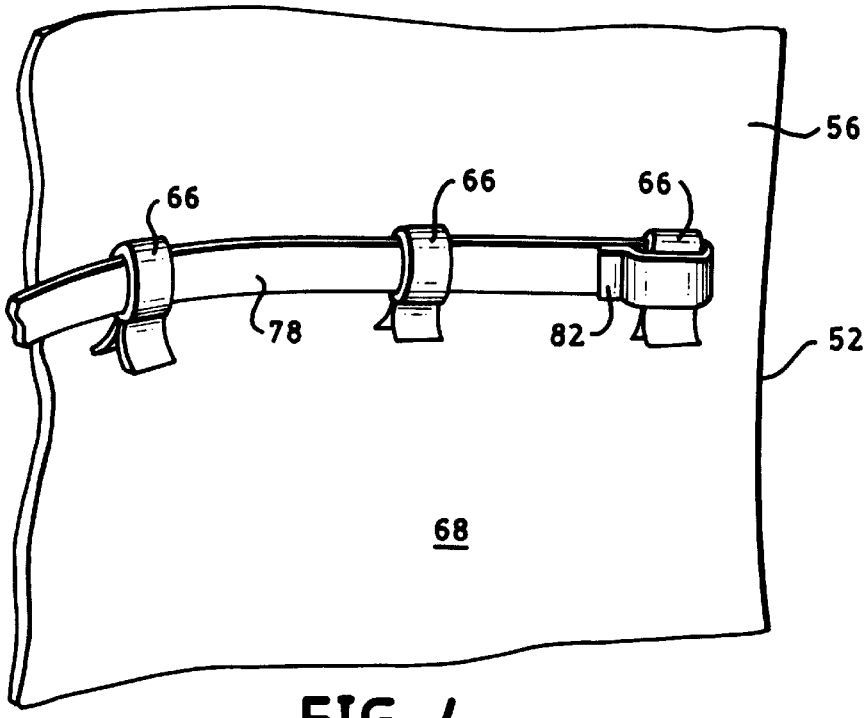
FIG. 4 is a partial interior view of an alternate embodiment of the backpack portion.

FIG. 4 illustrates another embodiment of the backpack 50 wherein an elastic member 78 is slidably received through at least one of the loops 66. As the elastic member 78 is threaded through the loops 66, a biasing force is applied to at least one of the ends of the elastic member 78 so that the elastic member 78 elongates to a stretched, biased length. While the elastic member 78 is in the stretched condition, the ends of the elastic member are secured to or about the loops 66 proximate to the edges 52, 54 through which the elastic member is threaded. As shown in FIG. 4, the end 82 of the elastic member 78 is secured about the loop 66 positioned proximate to edge 52 and to the elastic member 78 by stitching. The end 82 may be secured to the elastic member 78 by any of a variety of attachment methods, for example the attachment methods mentioned above. Upon release of the biasing force, the elastic member 78 recovers at least a portion of its elongation to gather the outer protective layer 56. The end 82 of the elastic member 78 may also be attached to the loop 66 or the interior surface of the outer protective layer.

When the wearer enters the protective garment 20, the elastic member or members 78 elongate, permitting expansion of the gathered outer protective layer 56 to accommodate the equipment worn by the wearer. After the wearer has donned the protective garment 20, the elastic member or members 78 recover and draw the outer protective layer 56 toward the equipment, thus causing the backpack 50 to conform to the equipment worn by the wearer.

The elastic member 78 may comprise an elastic tape which is elongatable upon application of a biasing force to at least twenty-five percent (25%) of its relaxed unbiased length. For example, elastic tapes having elongations of at least fifty percent (50%), or seventy five percent (75%) or one hundred percent (100%) are also acceptable. Additionally, elastic tapes having a minimum elongation less than twenty-five percent (25%) may also be used. The elastic member 78 will recover at least a portion of its elongation upon release of the biasing force. Such an elastic member may have a recovery of between 10% and 100%, although elastic members having a recovery of less than 10% may be utilized. A latex tape, such as Fulflex 7211, available from Fulflex, Inc. of Middletown, R.I. may be utilized. A non-latex tape or other type of elastic member may also be utilized. A particular embodiment may utilize elastic tapes having a width of between 25 and 38 centimeters, although other widths may be utilized.

In a particular embodiment, at least two elastic members 78 are used to conform the backpack 50 to the equipment, each elastic member 78 being threaded through a set of loops 66, the elastic members being positioned on the backpack 50 in a spaced apart relation.

Figure 5:
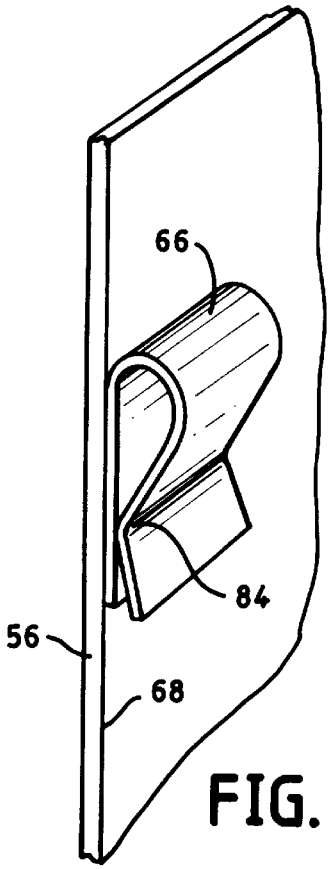
FIG. 5 is a partial perspective view of the interior of the backpack portion depicting a loop and the outer protective layer.
Figure 6:
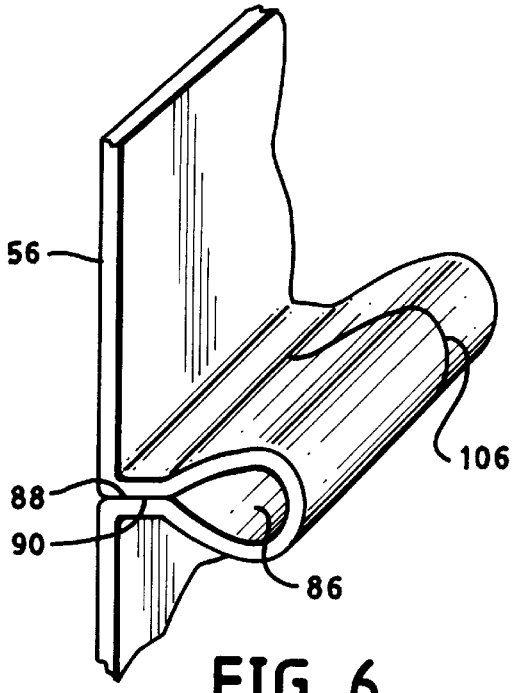
FIG. 6 is a partial perspective view of the interior of another embodiment of the backpack portion depicting a channel formed from the outer protective layer.

FIGS. 5 and 6 depict two of the many possible configurations for slidably securing the elastic member 78, the drawstring 70 or another gathering member to the interior surface 68 of the outer protective layer 56. FIG. 5 depicts a strap of material folded over upon itself to form the loop 66 shown therein, the loop 66 having an attachment area 84 which enables the loop 66 to be attached to the interior surface 68 of the outer protective layer 56. In alternate embodiments, the loops 66 may be attached to an inner web or layer which may, in turn, be attached to the interior surface 68. The loop 66 may be attached by ultrasonic, thermal or adhesive bonding, or any of the aforementioned attachment methods.

Alternately, as depicted in FIG. 6, the drawstring 70, elastic member 78 or the like may be slidingly received within and/or attached to a channel 86. The channel 86 may be mounted to or integral with the outer protective layer 56. As shown in FIG. 6, the channel 86 may be formed by folding the outer protective layer 56 upon itself and adhering surfaces 88 and 90 to each other. In such an embodiment, it may be necessary to form a slit 106 in the outer protective layer 56 so that the drawstring and/or elastic member may be selectively threaded through portions of the channel 86.

Figure 7:
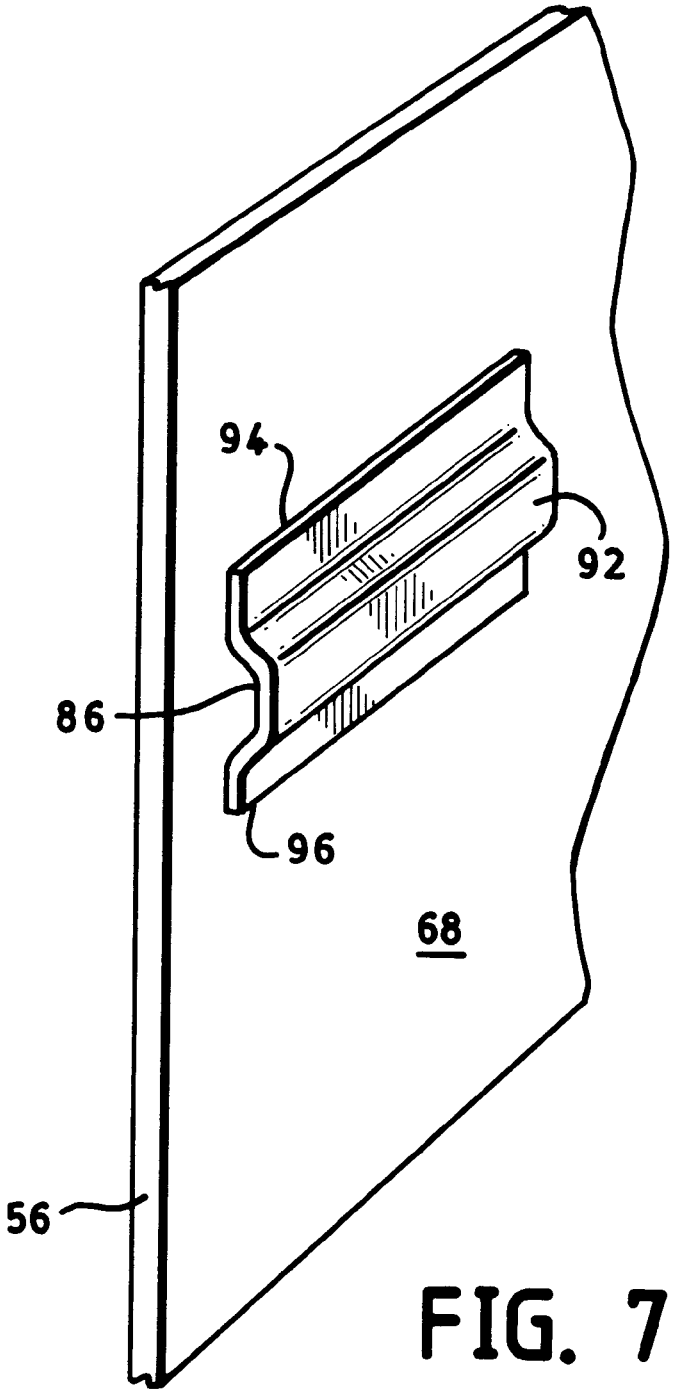
FIG. 7 is a partial perspective view of the interior of another embodiment of the backpack portion depicting a channel formed on the outer protective layer.

Alternately, as depicted FIG. 7, the channel 86 may be formed along the interior surface 68 by attaching an section of material 92 thereto. The edges 94, 96 of the section of material 92 are secured to the interior surface 68. Thus, a channel 86 is formed which is bounded by the interior surface 68 and the inner surface of the section of material 92. Various other configurations of the channel 86 are likewise suitable for use in the present invention.

The elastic member 78 may be threaded through the channel 86 and may be secured to the outer protective layer 56 or section of material 92 at an end 82 and/or at several points along the length of the elastic member 78 by any one of the aforementioned attachment methods. Likewise, the drawstring 70 may be secured to the outer protective layer 56 or section of material 92 after being slidably received therein, at, for example, an end 72 or 74. Additionally, the drawstring 70 may be secured to the outer protective layer or section of material 92 by any of a variety of attachment methods disclosed herein at one or more points along the length of the drawstring 70, leaving both ends 72, 74 of the drawstring 70 free to be pulled and secured in their shortened position by barrel locks 76 or the like. The elastic member 78 or drawstring 70 may be directly attached to the interior surface 68 of the outer protective layer 56 by bonding, taping or other similar method.

Figure 8:
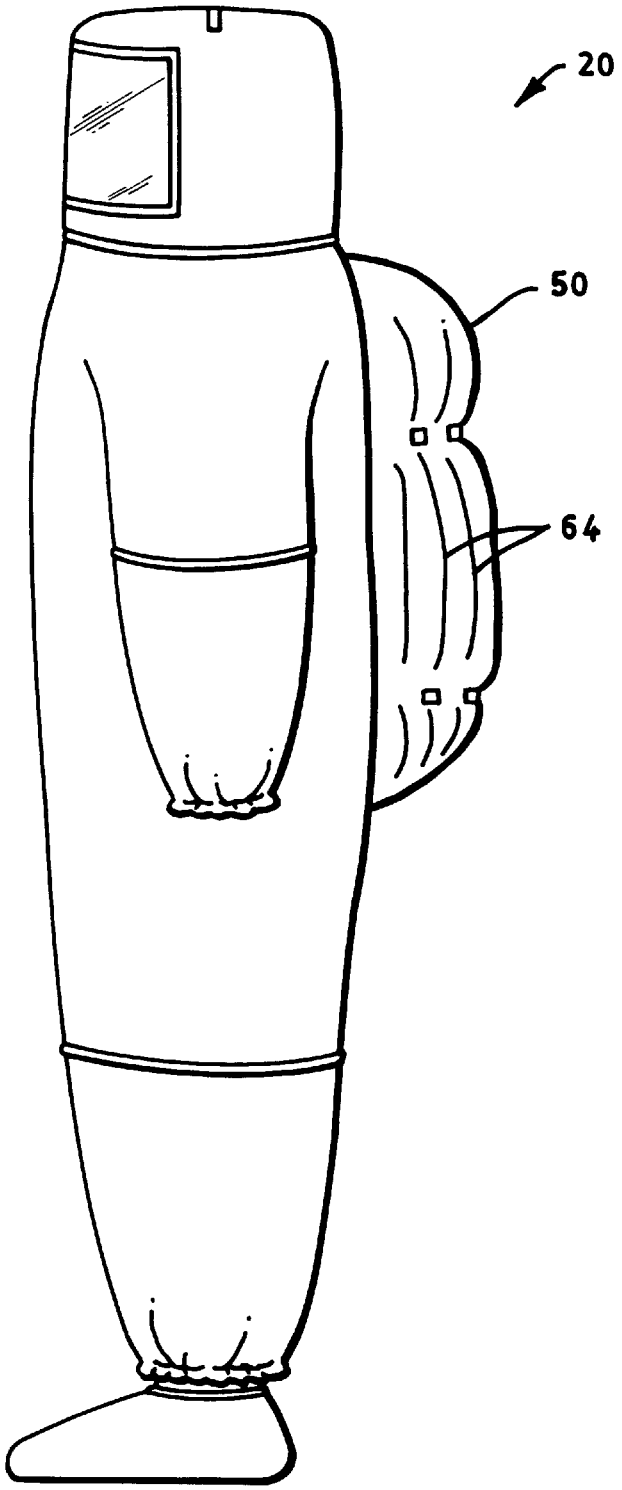
FIG. 8 is a side view of one embodiment of the protective garment of the present invention.

FIG. 8 illustrates a side view of an alternate embodiment of the present invention, showing the backpack 50 in its gathered position wherein it conforms to equipment worn by the wearer. In the embodiment depicted therein, two drawstrings or elastic members are utilized to urge the backpack to conform to the equipment worn by the wearer, although more than two such drawstrings or elastic members may be utilized.

Although the embodiments depicted herein show the loops, drawstrings, elastic members and channels positioned on an interior surface of the backpack, these elements, as well as other similar mechanisms which may be used to gather the backpack, may be positioned on the exterior surface of the backpack.

Figure 9:
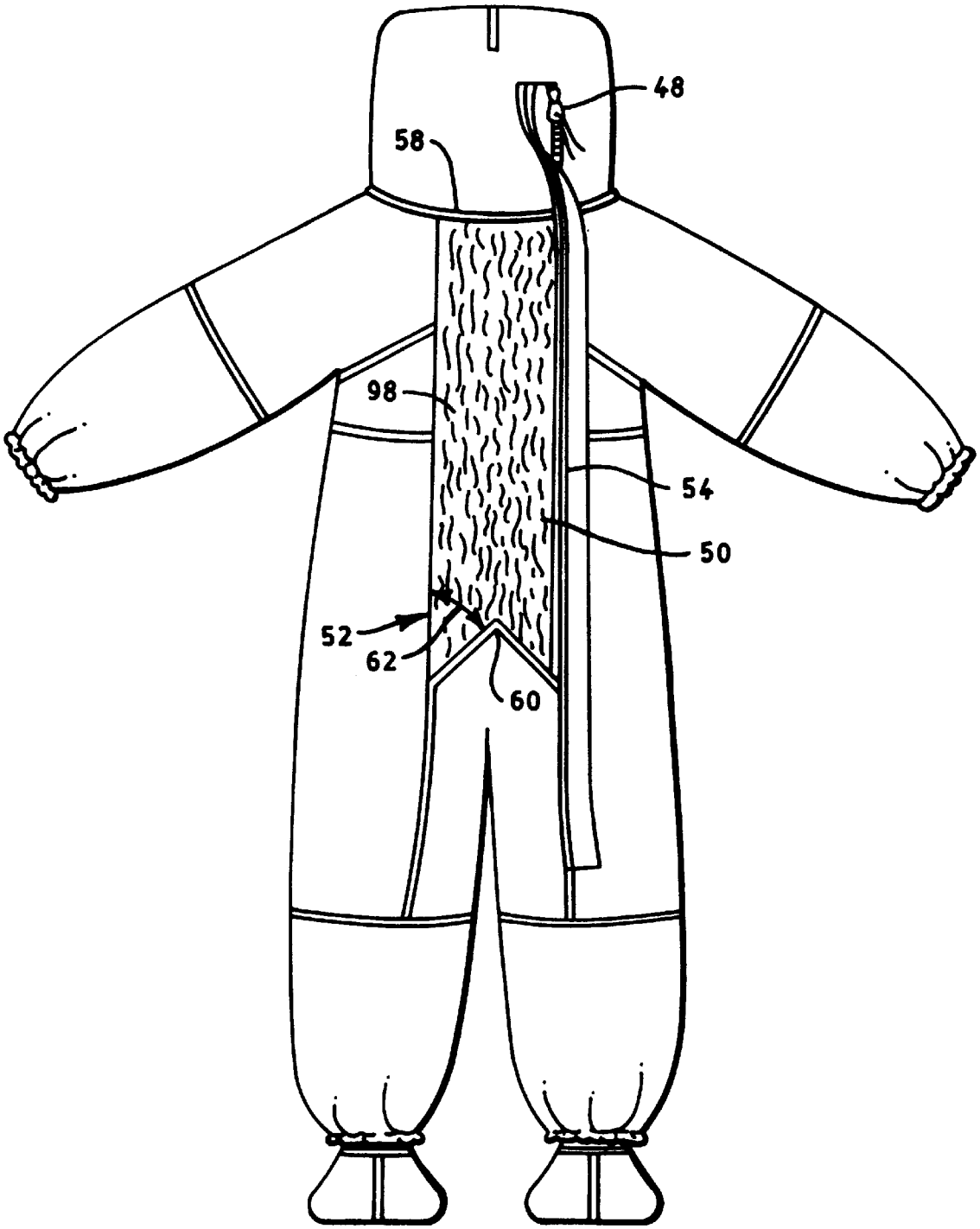
FIG. 9 is a rear view of yet another embodiment of the protective garment of the present invention.

In the embodiment depicted in FIG. 9, the backpack 50 is formed from an elasticized sheet 98 which provides the appropriate level of liquid chemical resistance and also demonstrates sufficient particle holdout efficiency while being expandable to conform to the equipment worn by the wearer.

Figure 10:
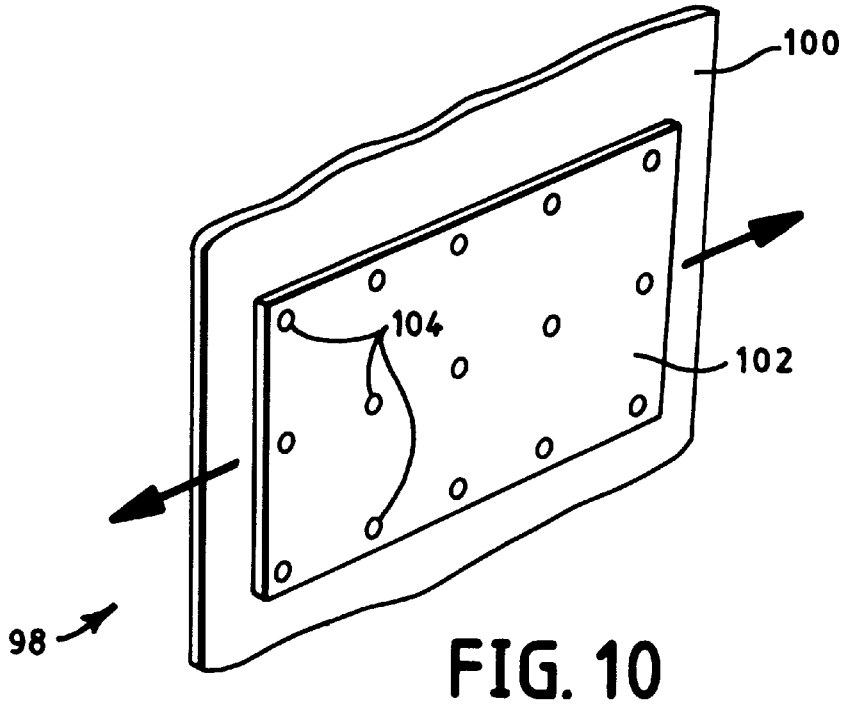
FIG. 10 is a partial perspective view of the interior of the embodiment of the backpack portion depicted FIG. 9.
Figure 11:
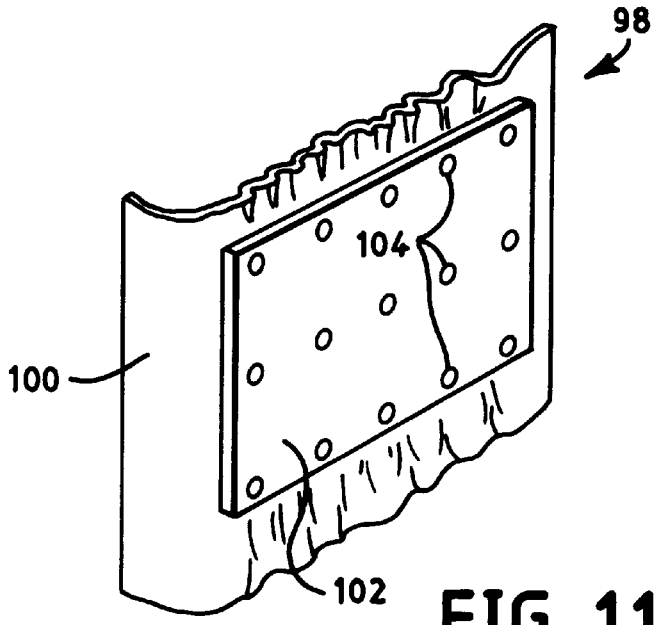
FIG. 11 is another partial perspective view of the interior of the embodiment of the backpack portion depicted in FIG. 9.

As shown in FIGS. 10 and 11, the elasticized sheet 98 may be a composite elastic material comprising at least one gatherable, nonelastic web 100 having particle resistance properties, the gatherable web 100 being bonded to at least one elastic web 102, which may or may not possess particle resistant properties. Composites of elastic and nonelastic material have been made by bonding the nonelastic material to the elastic material while the elastic material is in a stretched condition so that, when the elastic material is relaxed, the nonelastic material gathers or puckers between the locations where it is bonded to the elastic material. The resulting composite elastic material is stretchable to the extent that the nonelastic material gathered between the bond locations allows the elastic material to elongate. Examples of this type of composite materials are disclosed, for example, by U.S. Pat. No. 4,720,415 to Vander Wielen et al., issued Jan. 19, 1988 and by U.S. Pat. No. 4,918,747 to Morman, issued Jan. 1, 1991.

As shown in FIGS. 10 and 11, the elastic web 102 may be bonded to the gatherable web 100 at a plurality of spaced-apart locations 104 when the elastic web 102 is in an elongated position. As shown in FIG. 11, the gatherable web 100 is gathered between the bonded locations 104 upon relaxation of the elastic web 102.

The elastic web 102 and the gatherable web 100 may be joined by overlaying the materials and applying heat and/or pressure to the overlaid materials. Alternatively, the layers may be joined by using other bonding methods and materials such as, for example, adhesives, pressure sensitive adhesives, ultrasonic welding, high energy electron beams, and/or lasers. In one aspect of the present invention, the elastic web 102 may be formed directly onto the gatherable web 100 utilizing processes, such as, for example, melt-blowing processes and film extrusion processes.

The resultant composite material is itself elastic, its non-elastic layer or layers being able to move with the stretching of the elastic web 102 by reason of the play or give provided by the gathers formed, upon relaxation of the stretched elastic web 102, in the non-elastic layers to which the nonelastic web or webs are bonded. Additionally, the elastic webs may also exhibit barrier properties such as liquid, particle or vapor resistance.

The original length of the nonelastic, gatherable web limits the attainable elongation of the composite material because the nonelastic web would act as a "stop" to prevent further or excessive stretching of the elastic web under the effect of stretching forces which are less than the failure strength of the nonelastic gathered web. Because the elastic web may be bonded to a non-elastic material, by which is meant generally any suitable material which lacks the characteristics of an elastic as defined above, the nonelastic material tends to have a limiting effect on the degree of stretch and recovery of the elastic web.

The elastic web must be sufficiently strong to enable it to gather the gatherable web or webs to which it is bonded and, generally, the stiffer the gatherable web or webs are, the stronger must be the recovering force of the elastic web or webs bonded thereto.

A wide variety of materials may be employed as the elastic web, such as, for example, the elastic webs disclosed in U.S. Pat. No. 5,434,753, which is hereby incorporated by reference. The elastic webs used in this embodiment of the present invention may be stretchable to an elongation of at least about 25 percent of its relaxed length, i.e., can be stretched to at least about one and one quarter times its relaxed length, and, upon release of the stretching force will recover at least a portion of the elongation. Many elastic materials used in the practice of the invention can be stretched to elongations considerably in excess of 25%, although materials with elongations of less than 25% may be utilized.

Alternately, the material used in the present invention can be configured so that up to a significant portion of the elasticity of the material is lost upon application of the protective suit to a user wearing a backpack. Only a minimal amount of stretchability needs to be retained during use of the garment to keep the fabric of the garment conformed to the backpack. Said another way, only a minimum amount of recovery of the material of the backpack portion is required to keep the backpack portion conformed to the wearer.

FIG. 2 illustrates that, in some embodiments, the backpack 50 terminates at the bottom edge 60 with a seal or seam that is generally perpendicular (90 degrees) to the generally vertical outer edges 52, 54 of the backpack 50. This configuration is not totally satisfactory in that, during use, contaminates tend to collect at the backpack seam at 60. This configuration has a 90 degree contaminate runoff angle. The contaminate runoff angle is determined by measuring the angle formed by the outer edges 52, 54 of the backpack 50, when the wearer is standing, with the line formed by the lower termination of the backpack 50. This angle is denoted in FIGS. 2 and 9 at 62. In order to overcome this problem, it has been found to be desirable to angle the lower backpack seam 60 downward as illustrated in FIG. 9. This permits contaminates which fall in the gathers to run (if liquid) or fall (if solid) out of the bottom area and not collect therein. In other words, to affect runoff, this contaminate runoff angle should be less than 90 degrees. For example, the contaminate runoff angle may vary from between about 30 and 60 degrees. More particularly, the contaminate runoff angle may be about 45 degrees.

While selected embodiments of the present invention have been described herein, other backpack 50 configurations wherein the backpack conforms to the equipment and to the wearer will be readily apparent to those of skill in the art.

While the invention has been described in detail with respect to specific preferred embodiments thereof, it will be appreciated that those skilled in the art, upon attaining an understanding of the foregoing, may readily conceive of alterations to and variations of the preferred embodiments. Such alterations and variations are believed to fall within the scope and spirit of the invention and the appended claims.

What is claimed is:

1. A protective garment adapted to enclose a wearer of the protective garment and equipment worn on the wearer's back, the protective garment comprising:

a head portion adapted to receive the head of the wearer, the head portion including a view plate;

left and right arm portions adapted to receive the left and right arms of the wearer;

left and right leg portions adapted to receive the left and right legs of the wearer; and a body portion adapted to receive the body of the wearer, the body portion comprising a conformable backpack portion located on a back area of the body portion of the garment, the conformable backpack adapted to enclose and conform to equipment worn on the back of the wearer of the protective garment, the conformable backpack portion and the body portion each having an interior space, the interior space of the backpack portion being an extension of and contiguous with the interior space of the body portion.

2. The protective garment of claim 1, the conformable backpack portion comprising an outer protective layer and means for gathering the outer protective layer.

3. The protective garment of claim 2, the means for gathering the outer protective layer comprising at least one elastic member connected to the outer protective layer.

4. The protective garment of claim 2, the means for gathering the outer protective layer comprising a drawstring slidably connected to the outer protective layer.

5. The protective garment of claim 1, the conformable backpack portion being formed of an elasticized outer protective layer.

6. A protective garment adapted to enclose the head, arms, legs and torso of a wearer of the protective garment and equipment worn on the wearer's back, the protective garment comprising:

a conformable backpack portion located on a back area of the garment, the conformable backpack portion comprising an outer protective layer and means for gathering the outer protective layer of the backpack portion;

whereby the backpack portion is adapted to conform to equipment worn on the back of the wearer of the protective garment, the conformable backpack portion and the body portion each having an interior space, the interior space of the backpack portion being an extension of and contiguous with the interior space of the body portion.

7. The protective garment according to claim 6, wherein the means for gathering comprises at least one elastic member and means for connecting the elastic member to an interior surface of the outer protective layer of the backpack portion.

8. The protective garment according to claim 6, wherein the means for gathering comprises at least one drawstring and means for connecting the drawstring to an interior surface of the outer protective layer of the backpack portion.

9. The protective garment according to claim 6, the means for gathering comprising a channel connected to an interior surface of the outer protective layer of the backpack portion.

10. The protective garment according to claim 9, the means for gathering further comprising a drawstring passing through at least a portion of the channel.

11. The protective garment according to claim 6, the means for gathering the outer protective layer comprising an elastic web connected to an interior surface of the outer protective layer.

12. The protective garment according to claim 11, the elastic web being connected to the interior surface by adhesive bonding.

13. The protective garment according to claim 6, wherein the backpack portion further comprises a bottom portion, the bottom portion comprising a contaminate runoff angle of from greater than 0 to 90 degrees.

14. The protective garment according to claim 13, wherein the contaminate runoff angle is from greater than 0 degrees to less than 90 degrees.

15. The protective garment according to claim 13, wherein the contaminate runoff angle is from about 30 degrees to about 60 degrees.

16. The protective garment according to claim 13, wherein the contaminate runoff angle is about 45 degrees.

17. A protective garment comprising:

a conformable backpack portion located on a back area of the garment, the conformable backpack portion comprising an outer protective layer; and at least one elastic member;

at least one loop mounted to an interior surface of the outer protective layer, the elastic member being slidably received within the loop;

whereby the backpack portion is adapted to conform to equipment worn on the back of a wearer of the protective garment.

18. The protective garment according to claim 17, the elastic member being attached to at least one loop.

19. A protective garment comprising:

a conformable backpack portion located on the back area of the garment, the conformable backpack portion comprising:

an outer protective layer, at least one drawstring, and at least one loop connected to the interior surface of the outer protective layer, the drawstring being slidably received within the loop;

whereby the backpack portion is adapted to conform to equipment worn on the back of the wearer of the protective garment.

20. The protective garment according to claim 19, the drawstring being attached to at least one loop.

21. A protective garment adapted to enclose the head, arm, legs and torso of a wearer of the protective garment and equipment worn on the wearer's back, the protective garment comprising:

a conformable backpack portion located on a back area of the garment, the conformable backpack portion comprising an outer protective layer, a channel connected to an interior surface of the outer protective layer, and an elastic member passing through at least a portion of the channel.

22. A protective garment including a body portion, the protective garment comprising:

a conformable backpack portion located on a back area of the body portion of the protective garment, the conformable backpack portion comprising:

an outer protective layer, means for gathering the outer protective layer of the backpack portion, and a bottom portion defining an upward concave arc;

whereby the backpack portion is adapted to conform to equipment worn on the back of a wearer of the protective garment, the conformable backpack portion and the protective garment each having an interior space, the interior space of the backpack portion being an extension of and contiguous with the interior space of the body portion.

23. A protective garment comprising:

a conformable backpack portion located on a back area of the garment, the conformable backpack portion comprising at least one elastic member, and a plurality of loops attached to an interior surface of the backpack portion, the elastic member being slidably received through at least one of the loops; and whereby the backpack portion is adapted to conform to equipment worn on a back of a wearer of the protective garment.

24. A protective garment comprising:

a conformable backpack portion located on a back area of the garment, the conformable backpack portion comprising at least one drawstring, and a plurality of loops attached to an interior surface of the backpack portion, the drawstring being slidably received through at least one of the loops; and whereby the backpack portion is adapted to conform to equipment worn on a back of a wearer of the protective garment.

* * * * *